US011162351B2

(12) United States Patent
Mericas et al.

(10) Patent No.: US 11,162,351 B2
(45) Date of Patent: Nov. 2, 2021

(54) TRACKING THE POSITION OF A DOWNHOLE PROJECTILE

(71) Applicant: Halliburton Energy Services, Inc., Houston, TX (US)

(72) Inventors: Christopher James Mericas, Houston, TX (US); Nicholas Frederick Budler, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 557 days.

(21) Appl. No.: 14/908,603

(22) PCT Filed: Nov. 11, 2013

(86) PCT No.: PCT/US2013/069474
§ 371 (c)(1),
(2) Date: Jan. 29, 2016

(87) PCT Pub. No.: WO2015/069297
PCT Pub. Date: May 14, 2015

(65) Prior Publication Data

US 2016/0160632 A1 Jun. 9, 2016

(51) Int. Cl.
*E21B 47/09* (2012.01)
*E21B 47/12* (2012.01)
*E21B 47/092* (2012.01)

(52) U.S. Cl.
CPC ..... *E21B 47/09* (2013.01); *E21B 47/092* (2020.05); *E21B 47/12* (2013.01)

(58) Field of Classification Search
CPC ..... E21B 47/09; E21B 47/0905; E21B 47/12
See application file for complete search history.

(56) References Cited

U.S. PATENT DOCUMENTS 4,966,233 A * 10/1990 Blount ..... E21B 27/02 166/162
5,323,856 A 6/1994 Davis et al.
(Continued)

FOREIGN PATENT DOCUMENTS

CA 2870609 A1 10/2013
WO 2015069297 A1 5/2015

OTHER PUBLICATIONS

International Search Report and Written Opinion for PCT/US2013/069474 dated Aug. 6, 2014.
(Continued)

*Primary Examiner* — Waseem Moorad
*Assistant Examiner* — Neel Girish Patel
(74) *Attorney, Agent, or Firm* — Gilliam IP PLLC

(57) ABSTRACT

Disclosed are systems of positional tracking of a downhole projectile using a downhole monitoring tool. One downhole monitoring tool includes a body, at least one sensor arranged on the body and configured to detect a wellbore projectile, an indicator chamber defined in the body and configured to retain an indicator substance, and an actuation device operatively coupled to the indicator chamber and in communication with the at least one sensor, wherein, when the at least one sensor detects the wellbore projectile, a command signal is sent to the actuation device to actuate the indicator chamber and thereby release at least a portion of the indicator substance through an ejection port.

21 Claims, 3 Drawing Sheets

(56) References Cited

U.S. PATENT DOCUMENTS 6,349,766 B1* 2/2002 Bussear ..... E21B 33/127 166/113
2003/0192695 A1* 10/2003 Dillenbeck ..... E21B 33/05 166/285
2004/0020636 A1* 2/2004 Kenison ..... E21B 23/03 166/66.6
2007/0235199 A1* 10/2007 LoGiudice ..... E21B 17/1028 166/386
2008/0173454 A1* 7/2008 Smithson ..... E21B 23/04 166/324
2009/0087912 A1* 4/2009 Ramos ..... C09K 8/032 436/27
2009/0151939 A1 6/2009 Bailey et al.
2010/0122813 A1 5/2010 Trummer et al.
2011/0042081 A1* 2/2011 Streich ..... C09K 8/42 166/269
2011/0042082 A1* 2/2011 Schultz ..... C09K 8/42 166/270
2012/0014211 A1 1/2012 Maida, Jr. et al.
2012/0103602 A1* 5/2012 Lackner ..... B01F 5/0496 166/250.12
2012/0118582 A1* 5/2012 Soni ..... E21B 34/14 166/374
2013/0014941 A1 1/2013 Tips et al.
2013/0048290 A1* 2/2013 Howell ..... E21B 34/08 166/305.1
2013/0091943 A1* 4/2013 Skillingstad ..... E21B 47/09 73/152.54
2013/0255938 A1 10/2013 Neer
2013/0264051 A1* 10/2013 Kyle ..... E21B 41/00 166/244.1
2014/0027104 A1* 1/2014 Holderman ..... E21B 23/04 166/53
2015/0041146 A1* 2/2015 Fripp ..... E21B 34/16 166/373
2015/0134253 A1* 5/2015 Ring ..... E21B 47/1015 702/6

OTHER PUBLICATIONS

Canadian Application Serial No. 2,926,390; Third Examiner's Letter; dated Oct. 24, 2018, 4 pages.
Canadian Application Serial No. 2,926,390; Office Action; dated Sep. 26, 2019, 5 pages.
Extended European Search Report from European Patent Application No. 13897201.3, dated Jul. 26, 2017, 10 pages.

* cited by examiner

TRACKING THE POSITION OF A DOWNHOLE PROJECTILE

BACKGROUND

The embodiments herein generally relate to wellbore operations and, more particularly, to positional tracking of a downhole projectile using a downhole monitoring tool.

Hydrocarbon-producing wells (e.g., vertical, deviated, and horizontal wells) are generally drilled using a drilling fluid pumped down a drill string and through a drill bit attached to the end of the drill string. The drilling fluid serves, among other things, to lubricate and cool the cutting surfaces of the drill bit, transport drill cuttings to the surface, control formation pressure, and maintain well stability. After drilling is complete, a casing string may be placed in the wellbore through which hydrocarbons will eventually flow. An annulus is formed between the casing string and the face of the wellbore, which may be partially or fully filled with cement in order to hold the casing string in place. In some applications, cementing of the annulus is not necessary and the casing string may be entirely uncemented.

Stimulation of hydrocarbon-producing wells may be achieved using hydraulic fracturing treatments. In hydraulic fracturing treatments, a treatment fluid is pumped into a portion of a subterranean formation at a rate and pressure such that the subterranean formation breaks down and one or more fractures are formed or enhanced. The resultant fractures serve to increase the permeability of the subterranean formation by connecting pores together and, thereby, increase the conductivity potential for extracting hydrocarbons therefrom. In some wellbores, portions of the wellbore are isolated so that each segment may be individually stimulated or otherwise treated.

Wellbore projectiles are often introduced into wellbore tubulars to perform certain operations. As used herein, the term "wellbore tubular" includes any type of oilfield pipe including, for example, drill string, casing string, production tubing, landing string, liners, combinations thereof, and the like. As used herein, the term "wellbore projectile" refers to, for example, a plug, a dart, a ball, a plunger, a combination thereof, and the like. In some applications, the wellbore projectile may be placed downhole through a wellbore tubular so as to actuate one or more downhole tools such as a packer, a liner hanger, an isolation valve, a running tool, combinations thereof, and the like. In some applications, the wellbore projectile may be conveyed downhole through a wellbore tubular in order to isolate portions of the wellbore for the introduction of certain wellbore fluids (e.g., gravel slurries, fracturing fluids, treatment fluids, cement slurries, etc.). In yet other applications, the wellbore projectile may be conveyed downhole so as to plug the wellbore or a portion of the wellbore. Other operations may also be achieved by releasing or placing a projectile downhole.

When placed downhole, the location of a projectile is preferably monitored so as to ensure that the wellbore projectile has reached an expected depth, such as the location of a downhole tool to be actuated. One method of monitoring the location of a projectile is by reading pressure changes at the surface due to fluid displacement. For instance, as the wellbore projectile travels down the wellbore tubular, it displaces fluid therein, resulting in pressure changes that can be monitored at the surface. However, such fluid displacement may be caused by downhole conditions that are entirely unrelated to the position of the wellbore projectile, such as unexpected restriction readings. As such, false positional readings of the wellbore projectile may be relayed to the surface, which may render certain wellbore operations ineffective, resulting in lost time and costs.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The embodiments herein generally relate to wellbore operations and, more particularly, to positional tracking of a downhole projectile using a downhole monitoring tool.

One or more downhole monitoring tools may be placed at known intervals along a wellbore tubular. The downhole monitoring tools include an indicator chamber that houses or otherwise retains an indicator substance that is detectable at the surface using one or more detection devices. When a sensor on the downhole monitoring tool senses a wellbore projectile as it moves through a wellbore tubular, the indicator substance may be released from the indicator chamber by an associated release mechanism. The indicator substance may be released into a flow path between the wellbore tubular and the subterranean formation, or any other such flow path that permits the indicator substance to be conveyed to the surface for detection. In some embodiments, for instance, the indicator substance may be conveyed to the surface in fluid disposed in the wellbore due to the back pressure of the well. In other embodiments, however, the indicator substance may be buoyant in comparison to the wellbore fluid such that it tends to float toward the surface.

Upon detection of the indicator substance by the detection device(s) at the surface, a well operator may be able to positively ascertain the location of the wellbore projectile relative to the placement of the downhole monitoring tool on the wellbore tubular. At that point, the well operator may confidently perform or otherwise undertake certain subterranean operations requiring wellbore projectile location confirmation.

Figure 1:
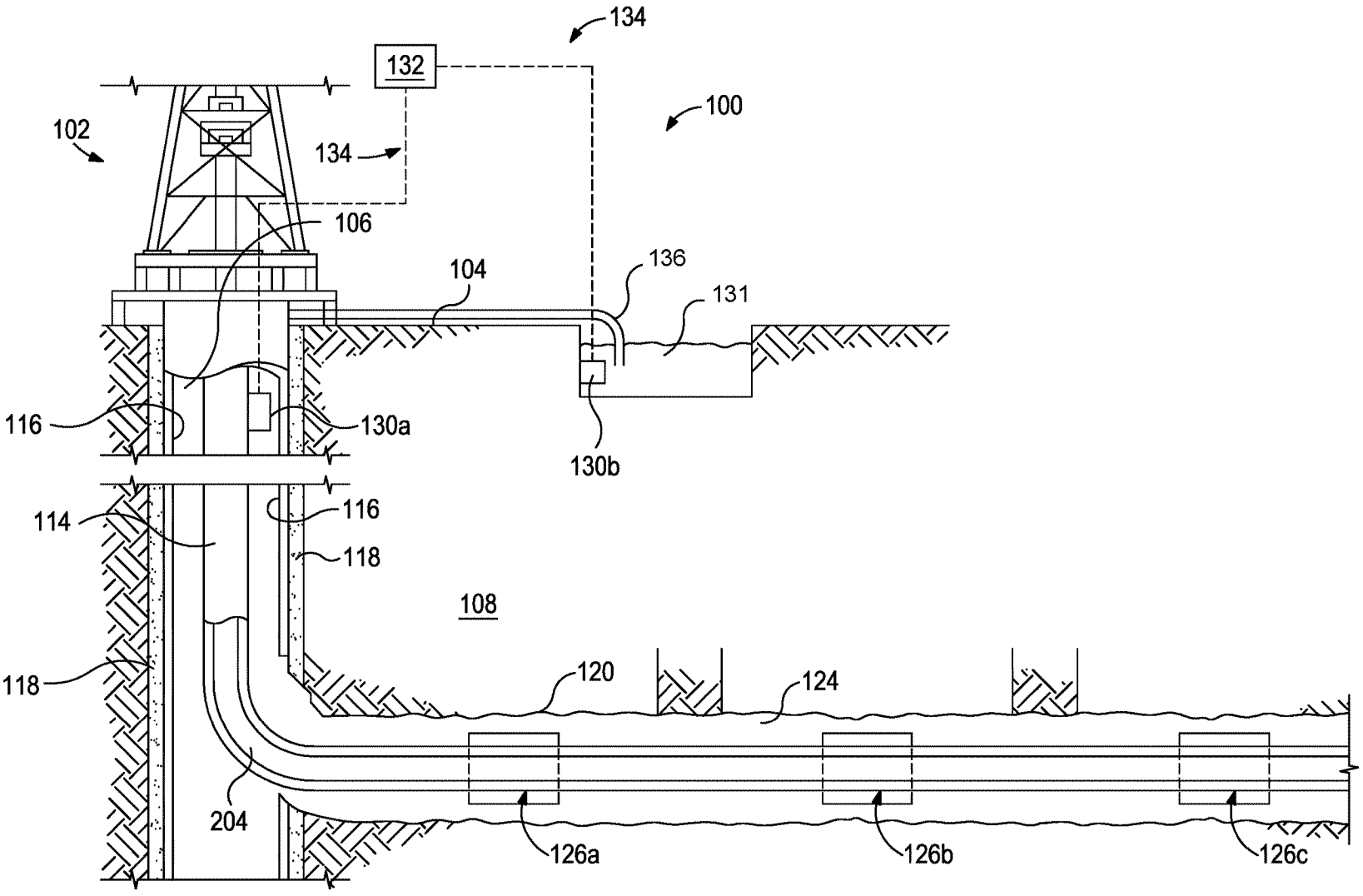
FIG. 1 is a schematic of an exemplary well system, which can embody or otherwise employ one or more principles of the present disclosure, according to one or more embodiments.

Referring to FIG. 1, illustrated is an exemplary well system 100 that may employ one or more embodiments of the downhole monitoring tool described herein. As illustrated, the well system 100 may include wellhead equipment 102 arranged at the Earth's surface 104 and a wellbore 106 extending therefrom and penetrating a subterranean formation 108. The wellhead equipment 102 may encompass a drilling rig, a wellhead installation, a Christmas tree, a work-over rig, a service rig, etc. It should be noted that, even though FIG. 1 depicts a land-based well system 100, it will be appreciated that the embodiments disclosed herein are equally well suited for use in any other type of rig including, but not limited to, floating or sea-based platforms and rigs, or rigs used in any other geographical location without departing from the scope of the disclosure.

In some embodiments, the wellhead equipment 102 may be an oil and gas rig configured for pumping and circulating drilling fluid through the interior of a wellbore tubular 114 to drill the wellbore 106. In such embodiments, drilling fluid may be returned to the surface 104 via an annulus or flow path 124 defined between an outer surface of the wellbore tubular 114 and the walls of the wellbore 106. At the surface 104, the drilling fluid may be deposited into an adjacent mud pit 131 via a pipe 136. In other embodiments, the wellhead equipment 102 and associated downhole tools may be used to stimulate and otherwise prepare the wellbore 106 and surrounding subterranean formation 108 for the production of hydrocarbons therefrom. In yet other embodiments, the wellhead equipment 102 may be a wellhead assembly configured for the production of hydrocarbons from the wellbore 106.

The wellhead equipment 102 may support or otherwise help manipulate the axial position of the wellbore tubular 114 as extended into the wellbore 106. In some embodiments, the wellbore tubular 114 may include, but not be limited to, one or more types of connected lengths of drill string, casing string, production tubing, landing string, liners, coiled tubing, combinations thereof, and the like. As illustrated in FIG. 1, the wellbore 106 may extend substantially vertically away from the surface 104 over a vertical wellbore portion. In other embodiments, the wellbore 106 may otherwise deviate at any angle from the surface 104 over a deviated or horizontal wellbore portion. In some embodiments, portions or substantially all of the wellbore 106 may be vertical, deviated, horizontal, and/or curved.

In an embodiment, the wellbore 106 may be at least partially cased with a casing string 116 or may otherwise remain at least partially or wholly uncased. The casing string 116 may be secured into position within the wellbore 106 using, for example, cement 118. In other embodiments, the casing string 116 may be only partially cemented within the wellbore 106 or, alternatively, may be entirely uncemented. A lower portion of wellbore tubular 114 may extend into a branch or lateral portion 120 of the wellbore 106. As illustrated, the lateral portion 120 may be an uncased or "open hole" section of the wellbore 106. In some embodiments, the entirety of the wellbore 106 is uncased.

The well system 100 may further include one or more downhole monitoring tools 126 (shown as 126*a*, 126*b*, and 126*c*) arranged in, coupled to, or otherwise forming an integral part of the wellbore tubular 114. In some embodiments, the downhole monitoring tools 126 may be coupled to the wellbore tubular 114 in the form of a sleeve surrounding the wellbore tubular 114. As illustrated, the downhole monitoring tools 126*a-c* may be spaced apart in substantially even or predetermined intervals. In other embodiments, the downhole monitoring tools 126*a-c* may be spaced apart in any interval provided that their downhole location is known by a well operator so that their location on the wellbore tubular 114, and thus their location in the wellbore 106, is known. While only three downhole monitoring tools 126*a-c* are depicted in FIG. 1, those skilled in the art will readily appreciate that more or less than three may be used, without departing from the scope of the disclosure. Moreover, the downhole monitoring tools 126*a-c* may be arranged in any configuration desired to fit a particular application.

It is noted that although FIG. 1 depicts horizontal and vertical portions of the wellbore 106, the principles of the apparatuses, systems, and methods disclosed herein may be similarly applicable to or otherwise suitable for use in wholly horizontal or vertical wellbore configurations, or any other wellbore configuration. Moreover, the use of directional terms, such as above, below, upper, lower, upward, downward, uphole, downhole, and the like, are used in relation to the illustrative embodiments as they are depicted in the figures herein, the upward direction being toward the top of the corresponding figure and the downward direction being toward the bottom of the corresponding figure, the uphole direction being toward the surface of the well and the downhole direction being toward the toe or bottom of the well.

Figure 2:
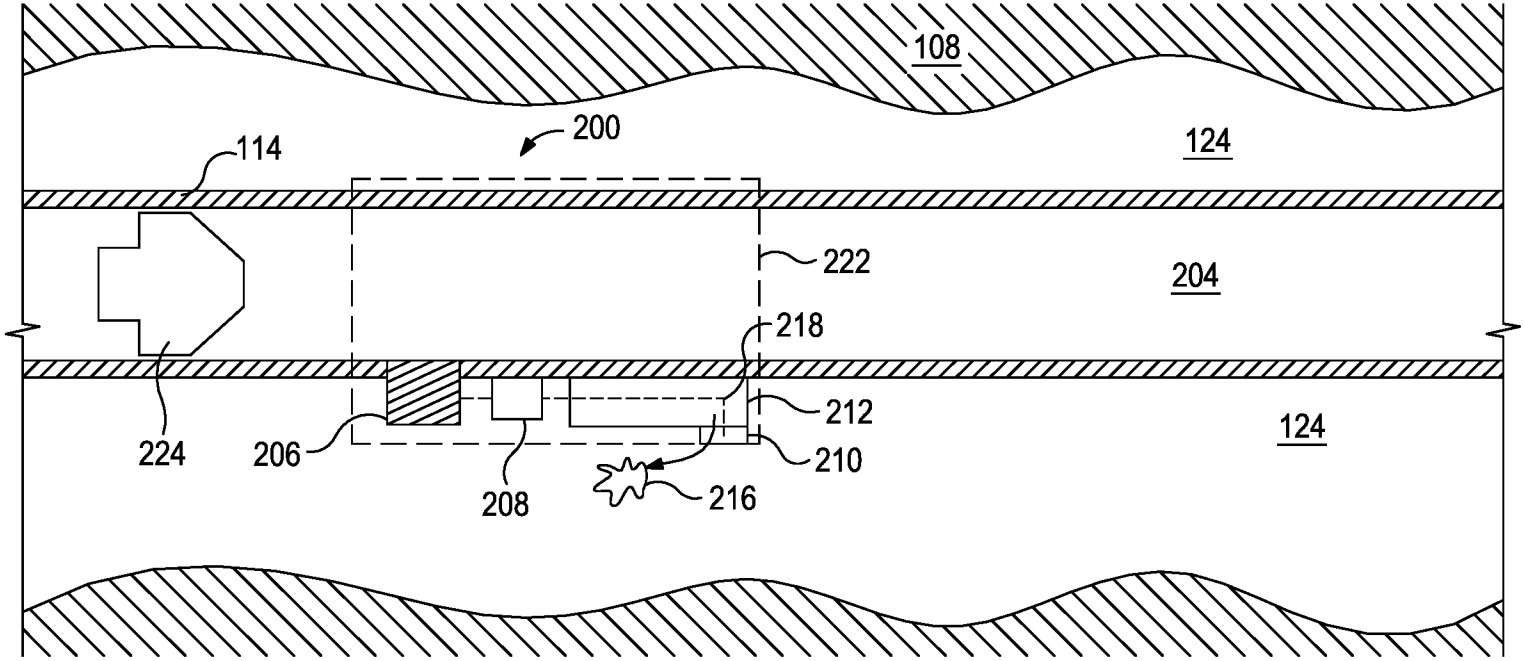
FIG. 2 is an enlarged cross-sectional view of an exemplary downhole monitoring tool, according to one or more embodiments.

Referring to FIG. 2, with continued reference to FIG. 1, illustrated is an enlarged cross-sectional view of an exemplary downhole monitoring tool 200, according to one or more embodiments described herein. The downhole monitoring tool 200 (hereafter "the tool 200") may be similar to one or all of the downhole monitoring tools 126*a-c* of FIG. 1 and therefore may replace any of the downhole monitoring tools 126*a-c* of the well system 100. In the illustrated embodiment in FIG. 2, the tool 200 may include a body 222 that includes a sensor 206 that is able to monitor or detect objects within an interior 204 of the wellbore tubular 114, at least one actuation device 208 operably coupled to or flanking the sensor 206 and an indicator chamber 212 or otherwise forming an integral part of the downhole monitoring tool 126, and an ejection port 210 defined in the indicator chamber 212 or otherwise forming an integral part of the downhole monitoring tool 200. The actuation device 208 and the indicator chamber 212 may be embedded in the wellbore tubular 114 or otherwise disposed on the outer surface of the wellbore tubular 114 in fluid communication with flow path 124. The ejection port 210 is in fluid communication with flow path 124.

The sensor 206 may be arranged within the body 222 and may be any sensor that is capable of identifying a wellbore projectile 224 as it axially traverses the location of the sensor 206 arranged on the wellbore tubular 114. Such sensors 206 may operate to identify the wellbore projectile 224 alone or in combination with a stimulus placed on the wellbore projectile 224 itself or emanating from it. In some embodiments, for example, the sensor 206 may be a magnetic sensor capable of detecting magnets placed on the surface of the wellbore projectile 224 or otherwise associated therewith. Magnetic sensors for use as the sensor 206 may include, but are not limited to, electromagnetic sensors, rare earth metal sensors, and the like.

In other embodiments, the sensor 206 may be an acoustic sensor encompassing an acoustic wave microphone capable of picking up the unique acoustic signature of the wellbore projectile 224 in the wellbore tubular 114. In yet other embodiments, the sensor 206 may be a pressure sensor capable of detecting changes in pressure caused by movement of the wellbore projectile 224 past the sensor 206. In exemplary embodiments, such a pressure sensor may be capable of discerning between pressure changes attributable to other wellbore movement and the abrupt pressure changes attributable to the movement of the wellbore projectile 224 past the sensor 206.

In another embodiment, the sensor 206 may be a radio frequency (RF) sensor capable of picking up a radio frequency identification tag (RFID) secured to or otherwise forming part of the wellbore projectile 224. The RF sensor may be configured to sense the RFID tag as the wellbore projectile 224 traverses the wellbore tubular 114 and encounters the sensor 206. In at least one embodiment, the RF sensor may be a micro-electromechanical system (MEMS) or a device capable of sensing radio frequencies. In such cases, the MEMS sensor may include or otherwise encompass an RF coil and thereby be used as the sensor 206.

In another application, the sensor 206 may be a mechanical sensor configured as a switch or the like that may be mechanically moved or manipulated through physical contact with the wellbore projectile 224 as it traverses the wellbore tubular 114. Upon physically interacting with the wellbore projectile 224, the mechanical switch may be configured to generate and send a signal indicative of the same to the actuation device 208. The mechanical sensor may be spring loaded or otherwise configured such that after the wellbore projectile 224 has passed (or following a certain time period thereafter) the switch may autonomously reset itself. As will be appreciated, such a resettable embodiment may allow the sensor 206 to physically interact with multiple wellbore projectiles 224.

The sensor 206 may be communicably coupled to the actuation device 208 and configured to communicate therewith upon detecting the wellbore projectile 224. Once the wellbore projectile 224 is detected, the sensor 206 may be configured to generate and send a command signal to the actuation device 208 to actuate the indicator chamber 212. The indicator chamber 212 may be filled with an indicator substance 216, and when the actuation device 208 actuates the indicator chamber 212, at least a portion of the indicator substance 216 may be ejected therefrom via the ejection port 210 and into the flow path 124.

The actuation device 208 may be any device capable of facilitating the ejection of the indicator substance 216 from the indicator chamber 212 through the ejection port 210. For instance, the actuation device 208 may be any mechanical, electromechanical, hydraulic, or pneumatic actuator or mechanism capable of generating a motion or force sufficient to allow at least a portion of the indicator substance 216 to exit the indicator chamber 212 via the ejection port 210.

Figure 3:
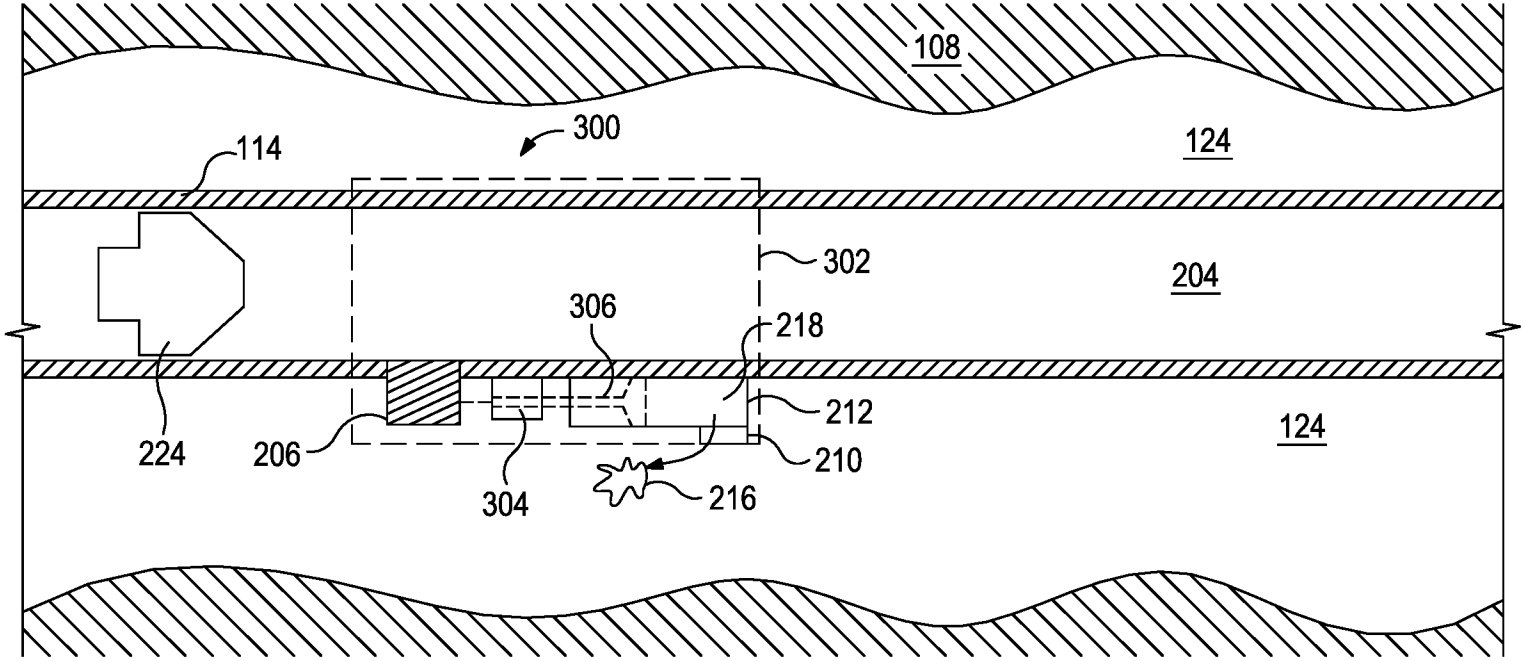
FIG. 3 is an enlarged cross-sectional view of another exemplary downhole monitoring tool, according to one or more embodiments.

Referring now to FIG. 3, with continued reference to FIGS. 1 and 2, illustrated is an enlarged cross-sectional view of another exemplary downhole monitoring tool 300, according to one or more embodiments. The downhole monitoring tool 300 (hereafter "the tool 300") may be substantially similar to the tool 200 of FIG. 2 and therefore may be best understood with reference thereto, where like numerals represent like elements not described again in detail. As illustrated, the tool 300 may include a body 302 that may house or otherwise have arranged therein the sensor 206 and the indicator chamber 212 with associated ejection port 210.

The tool 300 may further include an actuation device 304 communicably coupled to the sensor 206 and operatively coupled to the indicator chamber 212. As illustrated, the actuation device 304 may be a mechanical actuator or a piston solenoid valve that may include a plunger 306. The actuation device 304 may be configured to axially move the plunger 306 back and forth within the indicator chamber 212, thereby increasing the fluid pressure within the indicator chamber 212. In some embodiments, an increased fluid pressure within the indicator chamber 212 may serve to eject the indicator substance 216 from the indicator chamber 212 via the ejection port 210 and into the surrounding flow path 124.

In exemplary operation, when the sensor 206 detects or otherwise recognizes the presence of the wellbore projectile 224, the command signal may be sent to the actuation device 304 in order to manipulate the axial position of the plunger 306 within the indicator chamber 212. In some embodiments, the plunger 306 may be configured to extend fully into the indicator chamber 212, thereby ejecting all or substantially all of the indicator substance 216 through the ejection port 210 and into the flow path 124. In other embodiments, the plunger 306 may extend only partially into the indicator chamber 212 each time a wellbore projectile 224 triggers the sensor 206. In such embodiments, the plunger 306 may be configured to axially traverse the indicator chamber a predetermined distance such that only a portion of the indicator substance 216 is ejected through the ejection port 210 into the flow path 124.

The ejection port 210 may include or otherwise be a one-way valve or a check valve. In other embodiments, the ejection port 210 may include or otherwise encompass a burst disc, a membrane, a mechanical latch, a hinged door or gate, combinations thereof, and the like. Accordingly, the ejection port 210 may be configured to selectively eject portions of the indicator substance 216 based on the fluid pressure in the indicator chamber 212 and/or the axial position of the plunger 306 within the indicator chamber 212. The ejection port 210 may otherwise prohibit ejection of the indicator substance 216 once the pressure in the indicator chamber 212 reaches equilibrium after ejection of a portion of the indicator substance 216.

Referring again to FIG. 2, in one embodiment, the sensor 206 may be communicably coupled directly to the ejection port 210 and otherwise able to communicate an electrical command signal directly thereto via one or more communication lines 218. Once the sensor 206 detects the wellbore projectile 224, the electrical command signal may be sent to the ejection port 210, prompting the ejection port 210 to release the indicator substance 216 from the indicator chamber 212. In such an embodiment, the electrical command signal may, for example, trigger a small explosion, a rapid expansion, or a firing event at the ejection port 210 that results in fluid communication between the indicator chamber 212 and the flow path 124. In other embodiments, the electrical command signal may be configured to actuate a one-way valve, a mechanical latch, a door or gate associated with the ejection port 210 and thereby allow the indicator substance 216 to flow into the flow path 124.

Referring again to FIG. 2, in some embodiments, the downhole monitoring tool 200 may include an actuation device 208 substantially similar to those included in the remotely activated downhole apparatuses disclosed in U.S. Patent Publication No. 2013/0014941. In some embodiments, the actuation device 208 forming part of downhole monitoring tool 200 may be a hydraulic actuator (not shown) that may include a hydraulic fluid chamber having therein a plunger, a rupture disc, and a pushpin device. The hydraulic fluid chamber may be filled with any hydraulic fluid known to those skilled in the art. The plunger may be axially movable and held in any one place in the hydraulic fluid chamber by the pressure exerted upon it by the hydraulic fluid contained therein. A pathway may operably couple the hydraulic fluid chamber and the indicator chamber 212, the pathway capable of permitting fluid to flow therebetween. The rupture disc may be located in the hydraulic fluid chamber to form an effective boundary between the hydraulic fluid chamber and the indicator chamber 212. As will be appreciated by one skilled in the art, the location of the rupture disc and the pushpin device may be located anywhere within the hydraulic fluid chamber, the pathway, or indicator chamber 212, provided that an effective boundary between the hydraulic fluid chamber and the indicator chamber 212 is achieved. Additionally, the pushpin device may be any type of device (i.e., any shape, form, size, and the like) that is capable of puncturing or otherwise opening the rupture disc (e.g., in the form of a pin).

The hydraulic actuation device 208, as described herein, may be configured such that the rupture disc may be opened or otherwise broken by the pushpin device (e.g., the pushpin device punctures the rupture disc), resulting in a pressure imbalance between the hydraulic fluid chamber and the indicator chamber 212. The pressure imbalance may cause the plunger to move in an axial direction toward the indicator chamber 212. Such movement of the plunger within the hydraulic fluid chamber toward the indicator chamber 212 may evacuate or move some or all of the hydraulic fluid from the hydraulic fluid chamber, through the rupture disc and the pathway, and into the indicator chamber 212. The hydraulic fluid may be substantially immiscible with the indicator substance 216 and cause the indicator substance 216 to be ejected from the indicator chamber 212, through the ejection port 210 and into the low path 124.

In exemplary operation of a downhole monitoring tool 200 having a hydraulic actuation device 208, as disclosed herein, when the sensor 206 detects or otherwise recognizes the presence of the wellbore projectile 224, the command signal may be sent to the actuation device 208 in order to cause the pushpin device to puncture or otherwise open the rupture disc. Due to pressure imbalance, the plunger axially traverses at least a portion of the hydraulic fluid chamber causing hydraulic fluid to move through the rupture disc and the pathway, into indicator chamber 212. The presence of the hydraulic fluid in indicator chamber 212 causes the indicator substance 216 to be ejected from indicator chamber 212 through ejection port 210 and into flow path 124.

As will be appreciated by those of skill in the art, the rupture disc and pushpin device forming part of a hydraulic actuation device 208 may be replaced by any other mechanism capable of destroying an effective barrier between the hydraulic fluid chamber and the indicator chamber 212 and capable of being triggered by the sensor 206. For example, in some embodiments, the hydraulic fluid chamber may include, rather than the rupture disc and the pushpin device, a shifting sleeve (not shown) capable of forming an effective barrier between the hydraulic fluid chamber and the indicator chamber 212 when the actuation device 208 is not actuated, and sliding or otherwise destroying that barrier when the actuation device 208 is actuated.

In some embodiments, the ejection port 210 may be a mechanical latch that is triggered to open by the electrical command signal and remain open indefinitely. In such cases, the ejection port 210 may also be a burst disk that is irreparable upon trigger by the electrical conduit. In other embodiments, it may be preferable that the ejection port 210 release only a portion of the indicator substance 216 into the flow path 124. In such cases, the sensor 206 may be configured to send only a short electrical pulse each time a wellbore projectile 224 is detected. In such embodiments, the electrical pulse may result in the release of only a portion of the indicator substance 216 from the ejection port 210. Thus, one or more wellbore projectiles 224 may pass through the wellbore tubular 114, trigger the sensor 206, and eject the indicator substance 216 from a single downhole monitoring tool 200.

Referring again to FIG. 1, with continued reference to FIG. 2, the well system 100 may further include one or more detection devices 130 (shown as detection devices 130*a* and 130*b*). In some embodiments, the first detection device 130*a* may be arranged within the flow path 124 at or near the surface 104, and the second detection device 130*b* may be arranged at or near the mud pit 131. It will be appreciated that other detection devices may be arranged at any intermediate location within the flow path 124 (e.g., between the surface 104 and the downhole monitoring tools 126*a-c*) so long as the detection device remains capable of detecting the indicator substance 216 as it flows to the surface 104.

As illustrated, each detection device 130*a,b* may be communicably coupled to a computer system 132 or the like arranged at the surface 104 via one or more communication lines 134. The communication lines 134 may be any wired or wireless means of telecommunication between two locations and may include, but are not limited to, electrical lines, fiber optic lines, radio frequency transmission, electromagnetic telemetry, acoustic telemetry, or any other type of telecommunication means known to those skilled in the art. In at least one embodiment, the detection devices 130*a,b* may each form an integral part of the computer system 132.

In exemplary operation, the detection devices 130*a,b* may be configured to continuously monitor the flow path 124 for the indicator substance 216 as it flows toward the surface 104 upon being released from the indicator chamber 212 through the ejection port 210 (FIGS. 2 and 3). Once the detection devices 130*a,b* detect the indicator substance 216 (or a particular characteristic thereof), a signal indicating such detection may be communicated to the computer system 132 through the communication line(s) 134. A well operator may then be able to consult the computer system 132 and thereby become apprised of the location of one or more wellbore projectile(s) 224 (FIGS. 2 and 3) within the wellbore tubular 114. In some embodiments, the computer system 132 may include one or more peripheral devices associated therewith (e.g., a monitor, a print out from a printer, an audible alarm, a visual alarm, and the like) that are configured to alert the well operator of the location of the wellbore projectiles 224 once the detection devices 130*a,b* affirmatively detect the indicator substance 216 (or a particular characteristic thereof).

The detection devices 130*a,b* may be any physical, mechanical, or electrical gauges, sensors, or means capable of detecting a characteristic of the indicator substance 216. As used herein, the term "characteristic" refers to a chemical, mechanical, or physical property of the indicator substance 216. Illustrative characteristics of the indicator substance 216 that can be detected or otherwise monitored with the detection device(s) 130*a,b* may include, for example, RF tags, MEMS tags, chemical composition (e.g., identity and concentration in total or of individual components), phase presence, impurity content, pH, viscosity, density, ionic strength, total dissolved solids, salt content, porosity, opacity, bacteria content, concentrations thereof, combinations thereof, color, state of matter (e.g., solid, liquid, gas, emulsion, mixtures, etc.), acoustic signature, and the like. Other exemplary characteristics can include volumetric flow rate or mass flow rate. In some embodiments, for instance, one or more of the detection devices 130*a,b* may be an RF sensor, a MEMS sensor, a spectrometer, an optical computing device including one or more integrated computational elements, a salinometer, a pH meter, densometer, and the like.

The indicator substance 216 may be any substance capable of detection as it travels through the flow path 124 toward the surface 104 as distinguishable from the fluid already contained in the flow path 124. In at least one embodiment, the indicator substance 216 may be a substance that is more buoyant than the fluid within the flow path 124 and therefore able to flow toward the surface 104 through buoyancy. In some embodiments, the indicator substance 216 may be, but is not limited to, a hydrocarbon;

oil; a refined component of oil; petrochemical products; organic compounds; air; nitrogen; carbon dioxide; argon; helium; methane; ethane; butane; hydrocarbon gases; alcohols; esters; sugars; paints; waxes; and combinations thereof. In other embodiments, the indicator substance 216 may comprise an RF tag, a MEMS tag, a specific chemical composition that varies from the fluid in the flow path 124, a specific optical signature that varies from the fluid in the flow path 124 (e.g., fluorescence, luminescence, Raman, Mie, and/or Raleigh scattering), a solid substance (e.g., plastics, elastomers, syntactic foams, gas-filled metals, gas-filled ceramics, gas-filled glasses, composite materials and/or structures, thermoplastics, thermoset materials, combinations thereof, and the like), and the like.

In some embodiments, the indicator substance 216 is capable of being detected without the use of the detection devices 130*a,b* and may instead be readily visible via direct visual observation at the surface 104. For instance, a well operator may be capable of visually identifying or otherwise locating certain indicator substances 216 at the surface 104 (e.g., in mud pit 131). In such cases, the indicator substance 216 may be a colorimetric substance capable of physically changing the color of the fluid in flow path 124, and such color change may be optically visible without the use of a detection device. In other embodiments, the indicator substance 216 may be a solid substance that is carried to the surface 104 in the fluid in flow path 124 and visually detected by the well operator.

As used herein, the term "indicator substance" and any variation thereof, refers to a fluid or material to be tested or otherwise detected using a detection device or direct visual observation, as described herein. In some embodiments, the indicator substance 216 may be buoyant, such that it is generally buoyed up by a force equal to the weight of a surrounding fluid disposed in the flow path 124. In one or more embodiments, the indicator substance 216 may be entrained in the fluid disposed within the flow path 124 such that the hydraulic forces acting upon the indicator substance 216 cause it to move with the fluid flow in the flow path 124. The propensity for the indicator substance 216 to be entrained in the fluid disposed in the flow path 124 depends on the shape of the indicator substance 216 (or the particles which make it up), the viscosity of the fluid in flow path 124, the likelihood for the indicator substance 216 to be dissolved with the fluid in flow path 124, and the like. In some embodiments, the indicator substance 216 may be entrained in the fluid in the flow path 124 without being buoyant therein. In other words, the indicator substance 216 may be conveyed or otherwise flowed to the surface 104 by either being entrained or otherwise buoyant in the fluid in flow path 124, or a combination of the two.

As used herein, the term "fluid" refers to any substance that is capable of flowing, including, but not limited to, particulate solids, liquids, gases, slurries, emulsions, powders, muds, glasses, mixtures, combinations thereof, and the like. The fluid may be a single phase or a multiphase fluid. In some embodiments, the fluid may be an aqueous fluid, including water, brines, or the like. In other embodiments, the fluid may be a non-aqueous fluid, including organic compounds, more specifically, hydrocarbons, oil, a refined component of oil, petrochemical products, and the like. In some embodiments, the fluid can be a treatment fluid, a fracturing fluid, a packer fluid, or a formation fluid as found in the oil and gas industry. The fluid may also include any alcohols, esters, sugars, paints, waxes, combinations thereof, and the like. The fluid may also have one or more solids or solid particulate substances entrained therein. For instance, fluids can include various flowable mixtures of solids, liquids and/or gases. Illustrative gases that can be considered fluids according to the present embodiments include, for example, air, nitrogen, carbon dioxide, argon, helium, methane, ethane, butane, and other hydrocarbon gases, combinations thereof, and/or the like.

As used herein, the term "flow path" refers to a route through which a substance is capable of being transported between two points. In some cases, the flow path need not be continuous or otherwise contiguous between the two points. The flow path is not necessarily contained within any rigid structure, but refers to the path fluid takes between two points, such as where a fluid flows from one location to another without being contained, per se. It should be noted that the term "flow path" does not necessarily imply that a fluid is flowing therein, rather that a fluid is capable of being transported or otherwise flowable therethrough.

Embodiments disclosed herein include:

A. A downhole monitoring tool, comprising: a body; at least one sensor arranged on the body and configured to detect a wellbore projectile; an indicator chamber defined in the body and configured to retain an indicator substance; and an actuation device operatively coupled to the indicator chamber and in communication with the at least one sensor, wherein, when the at least one sensor detects the wellbore projectile, a command signal is sent to the actuation device to actuate the indicator chamber and thereby release at least a portion of the indicator substance through an ejection port.

B. A well system, comprising: a wellbore tubular extendable within a wellbore and defining a flow path therebetween, the wellbore tubular having an interior through which a wellbore projectile is conveyed; a downhole monitoring tool having a body coupled to the wellbore tubular at a predetermined location and including at least one sensor configured to detect the wellbore projectile once the wellbore projectile reaches the predetermined location; an indicator chamber defined in the body and configured to retain an indicator substance therein; and an actuation device operatively coupled to the indicator chamber and in communication with the at least one sensor, wherein, when the at least one sensor detects the wellbore projectile, a command signal is sent to the actuation device to actuate the indicator chamber and thereby release at least a portion of the indicator substance through an ejection port and into the flow path.

C. A method, comprising: introducing a wellbore projectile into a wellbore tubular arranged within a wellbore and defining a flow path therebetween; detecting the wellbore projectile with a sensor arranged on the wellbore tubular at a predetermined location; generating and sending a command signal with the sensor to an actuation device upon detecting the wellbore projectile; actuating an indicator chamber with the actuation device; releasing at least a portion of an indicator substance retained within the indicator chamber via an ejection port and into the flow path upon being actuated by the actuation device; and flowing the indicator substance toward a well surface of the wellbore.

Each of embodiments A, B, and C may have one or more of the following additional elements in any combination:

Element 1: Wherein the actuation device is a mechanical plunger.

Element 2: Wherein the sensor is at least one of a magnetic sensor, an acoustic sensor, a pressure sensor, a radio frequency sensor, and a mechanical sensor.

Element 3: Wherein the ejection port comprises at least one of a one-way valve, a burst disc, a membrane, a mechanical latch, a hinged door, a gate, and any combination thereof.

Element 4: Wherein the ejection port is configured to release substantially all of the indicator substance through the ejection port upon the at least one sensor detecting the wellbore projectile.

Element 5: Wherein the ejection port is configured to release only a portion of the indicator substance through the ejection port upon the at least one sensor detecting the wellbore projectile.

Element 6: Wherein the indicator substance is a solid selected from the group consisting of a plastic, an elastomer, a syntactic foam, a gas-filled metal, a gas-filled ceramic, a gas-filled glass, a composite material, a thermoplastic, a thermoset material, a radio frequency tag, a microelectromechanical system tag, and any combination thereof.

Element 7: Wherein the indicator substance is a fluid selected from the group consisting of a hydrocarbon, an oil, a refined component of oil, a petrochemical product, an organic compound, air, nitrogen, carbon dioxide, argon, helium, methane, ethane, butane, a hydrocarbon gas, an alcohol, an ester, a sugar, a paint, a wax, and any combination thereof.

Element 8: Wherein the indicator substance is conveyed to a well surface within the flow path and, upon reaching the well surface, is visually detectable by a well operator.

Element 9: Further comprising one or more detection devices arranged at or near a well surface, wherein the indicator substance is conveyed to a well surface within the flow path and, upon reaching the well surface, the one or more detection devices are configured to detect the indicator substance.

Element 10: Wherein at least one of the one or more detection devices is arranged within a mud pit.

Element 11: Wherein the one or more detection devices are configured to detect a characteristic of the indicator substance, the characteristic being selected from the group consisting of chemical composition, phase, impurity content, pH level, viscosity, density, total dissolved solids concentration, a salt content, a porosity, opacity, bacteria content, state of matter, color, and acoustic signature.

Element 12: Further comprising detecting the indicator substance with one or more detection devices arranged at or near the well surface; and communicating a signal to a computer system with the one or more detection devices upon detecting the indicator substance.

Element 13: Wherein the wellbore projectile is a first wellbore projectile and the predetermined location is a first predetermined location, the method further comprising: introducing a second wellbore projectile into the wellbore tubular; detecting the second wellbore projectile with a second sensor arranged on the wellbore tubular at a second predetermined location; generating and sending a second command signal with the second sensor to a second actuation device upon detecting the second wellbore projectile; actuating a second indicator chamber with the second actuation device; releasing a portion of a second indicator substance retained within the second indicator chamber into the flow path; and flowing the second indicator substance toward the well surface.

Element 14: Further comprising detecting the second indicator substance with the one or more detection devices; and communicating a second signal to the computer system with the one or more detection devices upon detecting the second indicator substance.

Element 15: Wherein the wellbore projectile is a first wellbore projectile and the portion of the indicator substance is a first portion, the method further comprising: introducing a second wellbore projectile into the wellbore tubular; detecting the second wellbore projectile with the sensor arranged on the wellbore tubular at the predetermined location; actuating the indicator chamber with the actuation device upon the sensor detecting the second wellbore projectile; and releasing a second portion of the indicator substance into the flow path via the ejection port.

By way of non-limiting example, exemplary combinations applicable to A, B, C include: A in combination with 1, 5, and 7; B in combination with 2, 4, and 8; C in combination with 3, 13, and 14.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The invention claimed is:

1. A downhole monitoring tool, comprising:

a body;

a non-chemical sensor arranged on the body to detect a wellbore projectile traveling through a wellbore tubular extendable within a wellbore and defining a flow path therebetween in a wellbore annulus, wherein the flow path is directed towards a well surface;

an indicator chamber defined in the body and configured to retain an indicator substance; and an actuation device operatively coupled to the indicator chamber and in communication with the non-chemical sensor, wherein, when the non-chemical sensor detects the wellbore projectile, a command signal is sent to the actuation device to actuate the indicator chamber to control release outward with respect to the surface of the wellbore tubular of at least a portion of the indicator substance into a wellbore annulus through an ejection port that is at least partially disposed on an outside surface of the wellbore tubular.

2. The downhole monitoring tool of claim 1, wherein the actuation device is a mechanical plunger.

3. The downhole monitoring tool of claim 1, wherein the non-chemical sensor is at least one of a magnetic sensor, an acoustic sensor, a pressure sensor, a radio frequency sensor, and a mechanical sensor.

4. The downhole monitoring tool of claim 1, wherein the ejection port comprises at least one of a one-way valve, a burst disc, a membrane, a mechanical latch, a hinged door, a gate, and any combination thereof.

5. The downhole monitoring tool of claim 1, wherein the ejection port is configured to release substantially all of the indicator substance through the ejection port upon the non-chemical sensor detecting the wellbore projectile.

6. The downhole monitoring tool of claim 1, wherein the non-chemical sensor is configured to detect at least one of: a magnet on the wellbore projectile, an acoustic signature of the wellbore projectile, a radio frequency tag of the wellbore projectile, or a non-chemical related physical contact from the wellbore projectile.

7. The downhole monitoring tool claim 1, wherein the indicator substance is a solid selected from the group consisting of a plastic, an elastomer, a syntactic foam, a gas-filled metal, a gas-filled ceramic, a gas-filled glass, a composite material, a thermoplastic, a thermoset material, a radio frequency tag, a microelectromechanical system tag, and any combination thereof.

8. The downhole monitoring tool of claim 1, wherein the indicator substance is a fluid selected from the group consisting of a hydrocarbon, a refined component of oil, a petrochemical product, an organic compound, air, nitrogen, carbon dioxide, argon, helium, methane, ethane, butane, a hydrocarbon gas, an alcohol, an ester, a sugar, a paint, a wax, and any combination thereof.

9. A well system, comprising:

a wellbore tubular extendable within a wellbore and defining a flow path therebetween in a wellbore annulus, the wellbore tubular having an interior through which a wellbore projectile is conveyed, wherein the flow path is directed towards a well surface;

a downhole monitoring tool having a body coupled to the wellbore tubular at a predetermined location and including a non-chemical sensor on the body to detect the wellbore projectile once the wellbore projectile is at or near the predetermined location;

an indicator chamber defined in the body and configured to retain an indicator substance therein; and an actuation device operatively coupled to the indicator chamber and in communication with the non-chemical sensor, wherein, when the non-chemical sensor detects the wellbore projectile, a command signal is sent to the actuation device to actuate the indicator chamber to control release outward with respect to the surface of the wellbore tubular of at least a portion of the indicator substance into the wellbore annulus through an ejection port that is at least partially disposed on an outside surface of the wellbore tubular.

10. The well system of claim 9, wherein the indicator substance is conveyed to a well surface within the flow path and, upon reaching the well surface, is visually detectable by a well operator.

11. The well system of claim 9, further comprising one or more detection devices arranged at or near a well surface, wherein the indicator substance is conveyed to the well surface within the flow path and, upon reaching the well surface, the one or more detection devices are configured to detect the indicator substance.

12. The well system of claim 11, wherein at least one of the one or more detection devices is arranged within the flow path.

13. The well system of claim 11, wherein at least one of the one or more detection devices is arranged within a mud pit.

14. The well system of claim 11, wherein the one or more detection devices are configured to detect a characteristic of the indicator substance, the characteristic being selected from the group consisting of chemical composition, phase, impurity content, pH level, viscosity, density, total dissolved solids concentration, a salt content, a porosity, opacity, bacteria content, state of matter, color, and acoustic signature.

15. A method, comprising:

introducing a wellbore projectile into a wellbore tubular arranged within a wellbore and defining a flow path therebetween in a wellbore annulus, wherein the flow path is directed towards a well surface;

detecting the wellbore projectile with a non-chemical sensor arranged on the wellbore tubular at a predetermined location;

generating and sending a command signal to an actuation device based upon the non-chemical sensor detecting the wellbore projectile;

actuating the actuation device based on the command signal to release outward with respect to the surface of the wellbore tubular at least a portion of an indicator substance retained within an indicator chamber via an ejection port and into the wellbore annulus, wherein the ejection port is at least partially disposed on the outside surface of the wellbore tubular; and determining at least an approximate location of the wellbore projectile based on detection of the indicator substance at or near the well surface of the wellbore.

16. The method of claim 15, further comprising visually detecting the indicator substance at the well surface.

17. The method of claim 15, further comprising:

detecting the indicator substance with one or more detection devices arranged at or near the well surface; and communicating a signal to a computer system with the one or more detection devices upon detecting the indicator substance.

18. The method of claim 17, wherein detecting the indicator substance with the one or more detection devices comprises detecting a characteristic of the indicator substance, wherein the characteristic is selected from the group consisting of chemical composition, phase, impurity content, pH level, viscosity, density, total dissolved solids concentration, a salt content, a porosity, opacity, bacteria content, state of matter, color, and acoustic signature.

19. The method of claim 17, wherein the predetermined location is a first predetermined location, the method further comprising:

detecting the wellbore projectile with a second non-chemical sensor arranged on the wellbore tubular at a second predetermined location;

generating and sending a second command signal to a second actuation device based upon the second non-chemical sensor detecting the wellbore projectile; and actuating the second actuation device, based on the second command signal, to release at least a portion of a second indicator substance retained within a second indicator chamber into the flow path.

20. The method of claim 19, further comprising:

detecting the second indicator substance with the one or more detection devices; and communicating a second signal to the computer system with the one or more detection devices upon detecting the second indicator substance.

21. The method of claim 15, wherein the wellbore projectile is a first wellbore projectile and the portion of the indicator substance is a first portion, the method further comprising:

introducing a second wellbore projectile into the wellbore tubular;

detecting the second wellbore projectile with the non-chemical sensor arranged on the wellbore tubular at the predetermined location;

actuating the indicator chamber with the actuation device upon the non-chemical sensor detecting the second wellbore projectile; and releasing a second portion of the indicator substance into the flow path via the ejection port.

* * * * *